US007907853B2

(12) United States Patent
Takesue et al.

(10) Patent No.: US 7,907,853 B2
(45) Date of Patent: Mar. 15, 2011

(54) IMAGE FORMING APPARATUS EXECUTING CALIBRATION AND SERVICE PERSON CALL

(75) Inventors: Toshihiro Takesue, Tokyo (JP); Takeshi Ogawa, Kanagawa-ken (JP); Seiji Miyahara, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 791 days.

(21) Appl. No.: 11/812,344

(22) Filed: Jun. 18, 2007

(65) Prior Publication Data

US 2007/0292146 A1 Dec. 20, 2007

(30) Foreign Application Priority Data

Jun. 19, 2006 (JP) ..... 2006-169396

(51) Int. Cl.
*G03G 15/00* (2006.01)
*G03G 15/04* (2006.01)

(52) U.S. Cl. ..... 399/8; 399/11; 399/32

(58) Field of Classification Search ..... 399/11, 399/8, 31, 32
See application file for complete search history.

(56) References Cited

U.S. PATENT DOCUMENTS 4,583,836 A * 4/1986 Taniguchi et al. ..... 399/31
5,715,496 A * 2/1998 Sawada et al. ..... 399/8
2003/0137577 A1* 7/2003 Shinohara
2004/0135877 A1* 7/2004 Ohba et al.
2005/0248801 A1 11/2005 Miyahara et al.
2007/0013927 A1 1/2007 Miyahara et al.

FOREIGN PATENT DOCUMENTS

JP 63262663 A * 10/1988
JP 08234635 A * 9/1996
JP 8-336055 12/1996
JP 2000-278471 10/2000
JP 2001353897 A * 12/2001
JP 2002268480 A * 9/2002
JP 2005032798 A * 2/2005
JP 2005-319652 11/2005

* cited by examiner

*Primary Examiner* — Susan S Lee
(74) *Attorney, Agent, or Firm* — Dickstein Shapiro LLP

(57) ABSTRACT

An image forming apparatus includes a condition determining device that calculates a deviation amount of image data from a normal condition and determines if the image forming apparatus is in an abnormal condition. An abnormal section specifying device specifies an abnormal section in the image forming apparatus based on a condition of the image forming apparatus. An image processing device executes image processing for abnormal use in accordance with an output of the abnormal section specifying device when the image data condition determining device determines that the image forming apparatus is in an abnormal condition. A service person call output device outputs a service person call signal indicative of calling a service person to a center when the image data condition determining device determines that the image forming apparatus is in an abnormal condition.

17 Claims, 16 Drawing Sheets

FIG. 16

TABLE 1

| GROUP NAME | INFORMATION TYPE | | | |
|---|---|---|---|---|
| | (1) | (2) | ··· | (k) |
| 1 | y11 | y12 | ··· | y1k |
| 2 | y21 | y22 | ··· | y2k |
| : | : | : | ··· | : |
| : | : | : | ··· | : |
| n | yn1 | yn2 | ··· | ynk |
| AVERAGE | y1 | y2 | ··· | yk |
| STANDARD DEVIATION | σ1 | σ2 | ··· | σk |

FIG. 17

TABLE 2

| GROUP NAME | INFORMATION TYPE | | | |
|---|---|---|---|---|
| | (1) | (2) | ··· | (k) |
| 1 | y11 | y12 | ··· | y1k |
| 2 | y21 | y22 | ··· | y2k |
| : | : | : | ··· | : |
| : | : | : | ··· | : |
| n | yn1 | yn2 | ··· | ynk |
| AVERAGE | 0 | 0 | ··· | 0 |
| STANDARD DEVIATION | 1 | 1 | ··· | 1 |

FIG. 18

$$Y_{ij} = (y_{ij} - y_j)/\sigma_j$$

FORMULA 1

FIG. 19

$$r_{pq} = r_{qp} = \frac{\Sigma(Y_{ip}Y_{iq})}{(\Sigma Y_{ip}^2 \Sigma Y_{iq}^2)^{1/2}}$$

FORMULA 2

FIG. 20

CORRELATION COEFFICIENT MATRIX $$R = \begin{pmatrix} 1 & r_{12} & r_{13} & \cdots & r_{1k} \\ r_{21} & 1 & r_{23} & \cdots & r_{2k} \\ r_{31} & r_{32} & 1 & \cdots & r_{3k} \\ \cdots & \cdots & \cdots & \cdots & \cdots \\ r_{k1} & r_{k2} & r_{k3} & \cdots & 1 \end{pmatrix}$$

FORMULA 3

FIG. 21

REVERSE MATRIX $$A = \begin{pmatrix} a_{11} & a_{12} & a_{13} & \cdots & a_{1k} \\ a_{21} & a_{22} & a_{23} & \cdots & a_{2k} \\ a_{31} & a_{32} & a_{33} & \cdots & a_{3k} \\ \cdots & \cdots & \cdots & \cdots & \cdots \\ a_{k1} & a_{k2} & a_{k3} & \cdots & a_{kk} \end{pmatrix}$$

FORMULA 4

FIG. 22

$$X_j = (x_j - y_j)/\sigma_j$$

FORMULA 5

FIG. 23

$$D^2 = (1/k)\Sigma a_{pq}X_pX_q$$

FORMULA 6

FIG. 24 FIG. 24A FIG. 24B

FIG. 24A

TABLE 3A

| DEVELOPMENT GAMMA (γ) VALUE | | | | DEVELOPMENT START VOLTAGE | | | | TONER DENSITY | | | | CHARGE VOLTAGE | | | |
|---|---|---|---|---|---|---|---|---|---|---|---|---|---|---|---|
| Bk | Y | M | C | Bk | Y | M | C | Bk | Y | M | C | Bk | Y | M | C |
| 1.39 | 1.41 | 1.63 | 1.58 | −7 | −19 | −17 | −9 | 3.21 | 2.75 | 2.98 | 2.84 | 620 | 600 | 580 | 580 |
| 2.06 | 1.09 | 1.29 | 1.26 | 3 | −33 | −22 | −23 | 3.31 | 2.28 | 2.48 | 2.58 | 580 | 700 | 640 | 640 |
| 1.42 | 1.72 | 1.79 | 1.23 | −11 | −7 | 1 | −20 | 3.38 | 2.10 | 2.47 | 2.63 | 620 | 580 | 580 | 660 |
| 1.40 | 1.49 | 1.08 | 1.39 | −28 | 20 | 31 | 17 | 3.50 | 2.25 | 2.68 | 2.57 | 600 | 580 | 700 | 620 |
| 1.08 | 1.14 | 1.08 | 1.18 | −11 | −27 | −29 | −25 | 3.34 | 2.13 | 2.45 | 2.40 | 720 | 680 | 700 | 660 |
| 1.35 | 1.25 | 1.27 | 1.25 | −17 | −31 | −26 | −25 | 3.21 | 2.01 | 2.37 | 2.37 | 640 | 640 | 640 | 640 |
| 1.37 | 1.46 | 1.40 | 1.31 | 17 | 18 | 18 | 21 | 3.19 | 2.27 | 2.73 | 2.78 | 620 | 600 | 600 | 640 |
| 1.05 | 1.00 | 1.07 | 1.17 | −18 | −30 | −39 | −33 | 3.23 | 2.39 | 2.35 | 2.42 | 660 | 740 | 660 | 660 |
| 1.24 | 1.33 | 1.48 | 1.85 | −12 | −24 | −20 | −6 | 2.97 | 2.13 | 2.37 | 2.28 | 660 | 700 | 580 | 620 |
| 1.41 | 1.36 | 1.27 | 1.49 | −16 | −22 | −23 | −11 | 3.29 | 2.08 | 2.35 | 2.31 | 620 | 620 | 640 | 600 |
| 1.37 | 1.14 | 1.28 | 1.41 | −27 | −29 | −23 | −14 | 3.00 | 2.15 | 2.47 | 2.43 | 600 | 680 | 640 | 620 |
| 1.72 | 1.34 | 1.32 | 1.17 | −2 | −20 | −14 | −29 | 3.69 | 2.32 | 2.61 | 2.63 | 580 | 620 | 640 | 660 |
| 1.49 | 1.11 | 1.13 | 1.19 | −13 | −25 | −23 | −24 | 3.46 | 2.50 | 2.65 | 2.61 | 600 | 700 | 680 | 660 |
| : | : | : | : | : | : | : | : | : | : | : | : | : | : | : | : |
| : | : | : | : | : | : | : | : | : | : | : | : | : | : | : | : |

FIG. 24B

TABLE 3B

| LD DRIVING CURRENT | | | | LD MONITOR CURRENT | | | | ENVIRONMENT | | COLORING AREA RATE | | | | VIBRATION | | | |
|---|---|---|---|---|---|---|---|---|---|---|---|---|---|---|---|---|---|
| Bk | Y | M | C | Bk | Y | M | C | TEM-PER-ATURE | HU-MID-ITY | Bk | Y | M | C | Bk | Y | M | C |
| 65.6 | 66.0 | 66.4 | 66.4 | 156 | 157 | 161 | 138 | 27.9 | 40 | 4.55 | 6.87 | 7.73 | 4.94 | 4.89 | 5.65 | 3.12 | 4.20 |
| 66.4 | 64.0 | 65.2 | 65.2 | 146 | 134 | 158 | 137 | 27.0 | 29 | 3.74 | 1.97 | 1.56 | 1.52 | 4.51 | 5.03 | 3.16 | 4.00 |
| 65.6 | 66.4 | 66.4 | 64.8 | 158 | 141 | 147 | 161 | 26.6 | 41 | 3.73 | 1.97 | 1.56 | 1.54 | 4.26 | 4.91 | 3.06 | 3.79 |
| 66.0 | 66.4 | 64.0 | 65.6 | 150 | 136 | 148 | 144 | 26.6 | 30 | 3.72 | 1.97 | 1.56 | 1.57 | 4.87 | 4.88 | 3.29 | 3.93 |
| 63.6 | 64.4 | 64.0 | 64.8 | 129 | 152 | 141 | 140 | 26.3 | 26 | 3.72 | 1.97 | 1.56 | 1.58 | 4.39 | 5.44 | 3.06 | 4.29 |
| 65.2 | 65.2 | 65.2 | 65.2 | 144 | 138 | 149 | 138 | 26.0 | 25 | 3.72 | 1.98 | 1.55 | 1.58 | 4.61 | 5.28 | 9.65 | 11.50 |
| 65.6 | 66.0 | 66.0 | 65.2 | 136 | 134 | 142 | 145 | 26.1 | 33 | 3.72 | 2.02 | 1.58 | 1.59 | 4.94 | 5.63 | 7.95 | 7.08 |
| 64.8 | 63.2 | 64.8 | 64.8 | 130 | 152 | 135 | 140 | 26.6 | 24 | 3.74 | 2.04 | 1.57 | 1.64 | 4.36 | 4.99 | 7.94 | 7.09 |
| 64.8 | 64.0 | 66.4 | 65.6 | 141 | 143 | 153 | 147 | 26.9 | 27 | 3.73 | 2.05 | 1.57 | 1.65 | 4.28 | 4.96 | 7.81 | 7.37 |
| 65.6 | 65.6 | 65.2 | 66.0 | 139 | 162 | 145 | 133 | 26.9 | 30 | 3.73 | 2.04 | 1.56 | 1.65 | 4.75 | 5.06 | 6.73 | 7.51 |
| 66.0 | 64.4 | 65.2 | 65.6 | 143 | 129 | 139 | 156 | 26.8 | 24 | 3.73 | 2.03 | 1.55 | 1.65 | 4.22 | 6.37 | 5.12 | 7.59 |
| 66.4 | 65.6 | 65.2 | 64.8 | 151 | 131 | 137 | 160 | 25.3 | 39 | 3.72 | 2.03 | 1.56 | 1.65 | 4.47 | 5.40 | 7.40 | 7.23 |
| 66.0 | 64.0 | 64.4 | 64.8 | 134 | 131 | 157 | 130 | 26.6 | 30 | 3.71 | 2.01 | 1.54 | 1.64 | 4.44 | 5.10 | 6.88 | 6.22 |
| : | : | : | : | : | : | : | : | : | : | : | : | : | : | : | : | : | : |
| : | : | : | : | : | : | : | : | : | : | : | : | : | : | : | : | : | : |

IMAGE FORMING APPARATUS EXECUTING CALIBRATION AND SERVICE PERSON CALL

CROSS REFERENCE TO RELATED APPLICATION

This application claims priority under 35 USC §119 to Japanese Patent Application No. 2006-169396 filed on Jun. 19, 2006, the entire contents of which are hereby incorporating by reference.

BACKGROUND OF THE INVENTION

1. Field of the Invention

The present invention relates to an image forming apparatus, such as a printer, a copier, a facsimile, a complex machine including functions of these apparatuses, etc., employing an electro-photographic system.

2. Discussion of the Background Art

As an electro-photograph engine employed in an image forming apparatus is demanded to have high resolution and to operate at high speed, a plurality of exposure devices are installed or an exposure device having a plurality of emission points is employed. As a result, a number of electronic devices for exposure is necessarily increased, recently. As an exposure device, a semiconductor laser is generally used.

However, since being significantly weak, the device is difficult to handle. As prior-arts, JPA Nos. 2000-278471 and 8-336055 are exemplified.

SUMMARY OF THE PRESENT INVENTION

Accordingly, an object of the present invention is to improve such background arts technologies and provides a new and novel image forming apparatus. Such a new and novel image forming apparatus includes a condition determining device that calculates a deviation amount of image data from a normal condition and determines if the image forming apparatus is in an abnormal condition. An abnormal section specifying device specifies an abnormal section in the image forming apparatus based on a condition of the image forming apparatus. An image processing device executes image processing for abnormal use in accordance with an output of the abnormal section specifying device when the image data condition determining device determines that the image forming apparatus is in an abnormal condition. A service person call output device outputs a service person call signal indicative of calling a service person to a center when the image data condition determining device determines that the image forming apparatus is in an abnormal condition.

In another embodiment, the condition determining device determines a deviation amount from the normal condition based on a performance of image color reproduction. The image processing device determines if an abnormality is present in an exposure system of the image forming apparatus when the condition determining device determines that the image forming apparatus is in the abnormal condition. The image processing device executes calibration for abnormal use based on the result of the abnormality presence determination.

In yet another embodiment, the condition determining device determines a deviation amount from the normal condition based on granularity of an image. The image processing device determines if an abnormality is present in an exposure system when the condition determining device determines that the image forming apparatus is in the abnormal condition. The image processing device executes halftone processing for abnormal use based on the result of the abnormality presence determination.

In yet another embodiment, the calibration includes one of output density correction processing for maintaining a gray balance and correction processing for correcting an exposure position.

In yet another embodiment, the halftone processing for abnormal use at least includes one of switching processing for decreasing a frequency of an image to be formed and switching processing for changing a screen angle.

In yet another embodiment, a career holding device holds a career of the deviation amount calculated by the condition determining device. The service person call output device outputs service person call information in accordance with the career information of the career holding device.

In yet another embodiment, the career information includes one of the deviation amount calculated by the condition determining device, a calibration interval calculated from a date when the image processing device executes previous calibration, and the total number of outputs of recording mediums when the calibration is executed. One of the deviation amount, the calibration interval, and the total number of outputs is segmentized into a prescribed number of groups in an order of a volume of the information, and the service person call is generated when a frequency of a prescribed group exceeds a prescribed reference.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIGS. 16 and 17 illustrate exemplary tables each showing configuration of conditional data obtained from an image forming apparatus;

FIGS. 18 to 23 illustrate formulas used in calculating the Mahalabinos' generalized distance; and FIGS. 24A and 24B collectively illustrates exemplary input information used in a MTS method.

DESCRIPTION OF THE PREFERRED EMBODIMENTS

Figure 1:
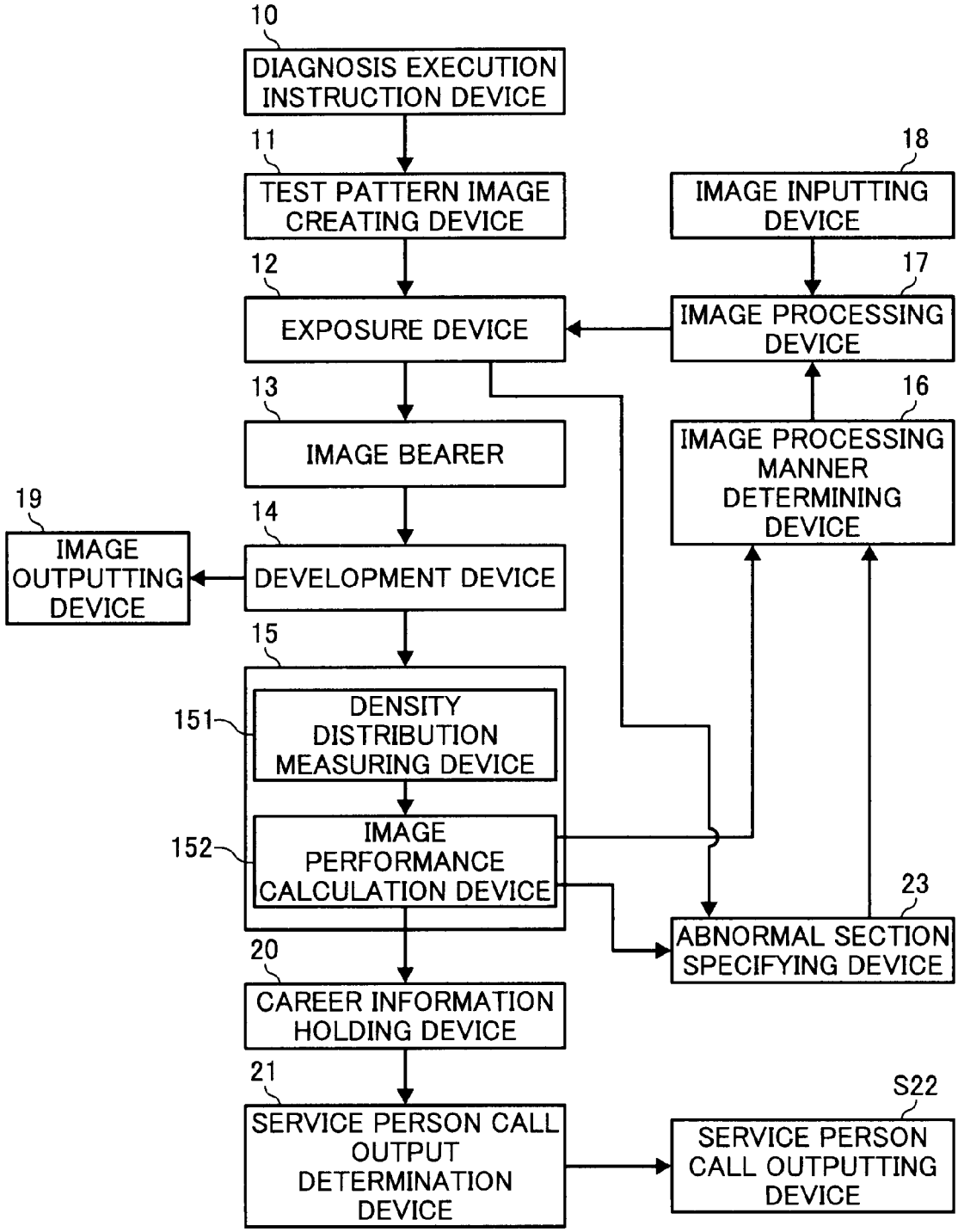
FIG. 1 illustrates an exemplary image forming apparatus according to one embodiment of the present invention.

Referring now to the drawing, wherein like reference numerals designate identical or corresponding parts throughout several views, in particular in FIG. 1, the image forming apparatus includes a diagnosis execution instruction device 10, a test pattern image creating device 11, an exposure (writing) device 12, an image carrier 13, a dev device 14, and an image quality detection section 15 serving as a condition determination device. Further included are an image processing manner determining device 16, an image processing device 17, and an image inputting device 18. Also included are an image outputting device 19, a career information holding device 20, and a service person call output determination device 21. In addition, a service person call output device 21, and an abnormal section specifying device 23 are included in the image forming apparatus.

When a user is dissatisfied with an image quality and instructs execution of diagnosis, the diagnosis execution instructing device (e.g. an operation section) 10 outputs a signal indicative of execution to the test pattern image creating device 11.

Figure 2:
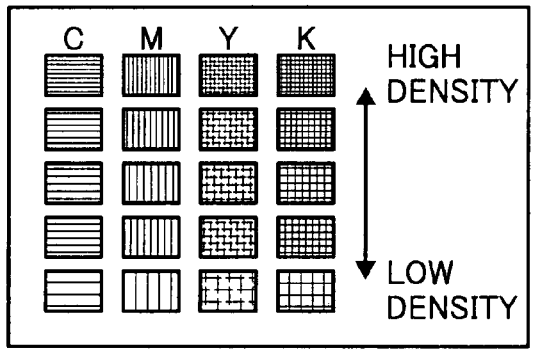
FIG. 2 illustrates an exemplary test pattern image.

The test pattern image creating device 11 creates and transmits a test pattern signal to the exposure device 12. For example, as illustrated in FIG. 2, a test pattern signal for outputting a pattern including patches per color, such as cyan (C), magenta (M), yellow (Y), black (K), etc., with density changing step by step from high to low.

The exposure device 12 forms a latent image on an image bearing member 13 such as a photoconductive member using a laser light modulated in accordance with a test pattern signal inputted thereto. The dev device 14 forms a toner image by developing the latent image formed on the image bearing member 13.

The image quality detection section 15 (serving as a condition determination device) includes a density distribution measurement device 151 and an image quality calculation device 152.

The density distribution measurement device 151 measures a distribution of the test pattern image. The image quality calculation device 152 calculates an amount of deviation from a normal condition with reference to information of a normal condition stored in an internal RAM, not shown. The image quality calculation device 152 determines a condition of the apparatus based on the deviation amount and transmits a determination result to the image processing manner determining device 16 and the abnormal section determination device 23.

The abnormal section determining device 23 determines an abnormal section based on a driving current of the semiconductor laser obtained from the exposure device 12, light intensity monitor information, and the calculation result obtained from the image quality calculation device 152.

The image processing manner determining device 16 determines an appropriate calibration amount or a halftone processing manner based on a deviation amount calculated by the image quality calculation device 152 and an output of the abnormal section determining device 23, and then stores such information in a RAM, not shown, in the image processing manner determining device 16. The image processing device 17 refers to a RAM, not shown, in the image processing manner determining device 16 and applies density correction and halftone processing to image data inputted thereto from the image inputting device 18. Then, a series of processing, such as transferring, fixing, etc., are executed after operations of the exposure device, the image bearer, and the developing device, and thereby an image is outputted.

Further, the image quality calculation device 152 transmits the deviation amount to the image processing manner determining device 16 and the career information holding device 20.

The career information holding device 20 stores thus inputted information in its internal RAM, not shown. The service person call output determination device 21 refers to the RAM of the career information holding device 20 and determines if a service person call is needed based on the career information stored therein. The service person call output determination device 21 instructs the service person call output device 22 to output a service person call when a service person call is needed. The service person call output device 22 then transmits the service person call to a communication destination via a telephone line or the like.

Figure 3A:
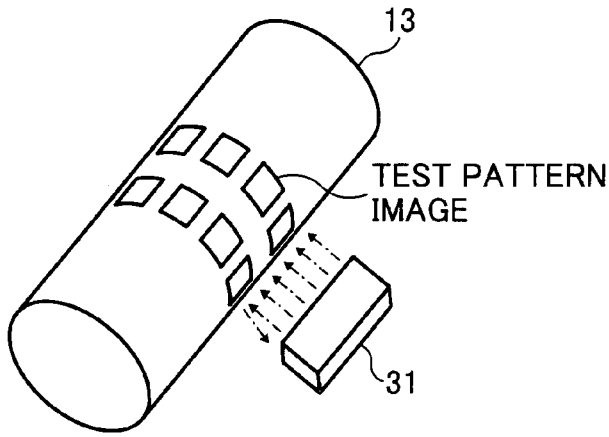
FIGS. 3A and 3B collectively illustrates an exemplary manner of reading the test pattern image using an optical sensor.
Figure 3B:
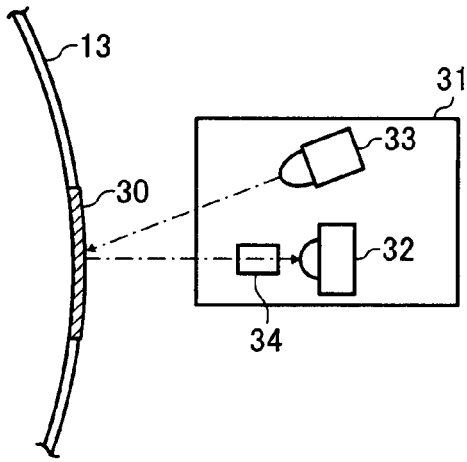

A density distribution measuring device 151 can be an optical sensor 31 as discussed in the jpo2003-219158 or the like. As shown in FIG. 3A, the optical sensor 31 two-dimensionally measures a density distribution by picking up density data of a toner image on each of the test patches formed on an image bearing member 13 in one dimension in a chronological order as the image bearing member 13 rotates. As shown in FIG. 3B, the optical sensor 31 includes a CCD line sensor 32, a light emitting device 33, and an optical member 34. Light emitted from the light emitting device 33 reaches a toner image 30 of each of the test patches formed on the image bearing member 13. Light reflected from the toner image 30 is received and imaged on the CCD line sensor 32 by the optical member 34. As a result, the two dimensional density distribution of the toner image 30 of each of the test patches can be measured.

Now, an exemplary sequence of a control operation of an image forming apparatus of FIG. 1 according to the first embodiment is described with reference to FIG. 4. Initially, when density of a solid toner image on an output decreases in step S11, a user instructs execution of calibration using the diagnosis execution instructing device 10 in step S12. When the diagnosis execution is thus instructed, the test pattern image creating device 11 transits a signal indicative of a test pattern image including test patches each having a different output density step by step (per mono color in case of a color output apparatus) to the exposure device 12. Then, the exposure device 12 forms latent images of test patches on the image bearing member 13, and the developing device 14 then develops the latent images.

The density distribution measuring device 151 measures a physical characteristic amount, such as density of a toner image on each of the test patches formed on the image bearing member 13.

A calibration as to density is executed as an image processing manner by the image quality calculation device in this embodiment. Thus, the image quality calculation device 152 uses density measured by the density distribution measuring device 151 as is and compares with density of a normal condition stored in the internal RAM.

Then, a deviation amount from the normal condition is calculated, and it is determined if the deviation amount can be corrected by an ordinary calibration in step S14. If the determination is positive, the image processing manner determining device 16 calculates and stores a calibration amount based on the deviation amount from the normal condition calculated by the image quality calculation device 152. Then, the image processing device 17 refers to the internal RAM and executes an ordinary calibration in step S15. For example, a correction is executed by changing an amount of supplying mono color toner and thereby adjusting a tone curvature in order to place density in the vicinity of a normal condition where a gray balance can be maintained.

Thus, image data inputted from the image inputting device 18 undergoes an appropriate density correction and halftone processing. Then, a series of processing including transferring and fixing is executed in the image outputting device 15 through the exposure device 12, the image bearing member 13, and the developing device 14. Thus, an image is outputted.

Further, the image quality calculation device 152 transmits the same information of the deviation amount to the career information holding device 20 as is transmitted to the image processing manner determining device 16.

The career information holding device 20 stores date information or the like in the RAM beside the deviation information transmitted from the image quality calculation device 152 in step S16. Then, the service person call output determination device 21 refers to the internal RAM in step S17 and determines if a condition for transmitting a service person call is met in step S18. The service person call output device 22 transmits a service person call signal to a prescribed communication destination via telephone line or the like in accordance with a determination result of the service person call output determination device 21 in step S119. As a manner of determination used by the service person call output determination device 21, various ones can be employed. For example, as shown in FIGS. 5A and 5B, a deviation amount can be segmented into groups with a prescribed width, and a frequency can be measured per group in accordance with an amount of deviation.

Figure 5A:
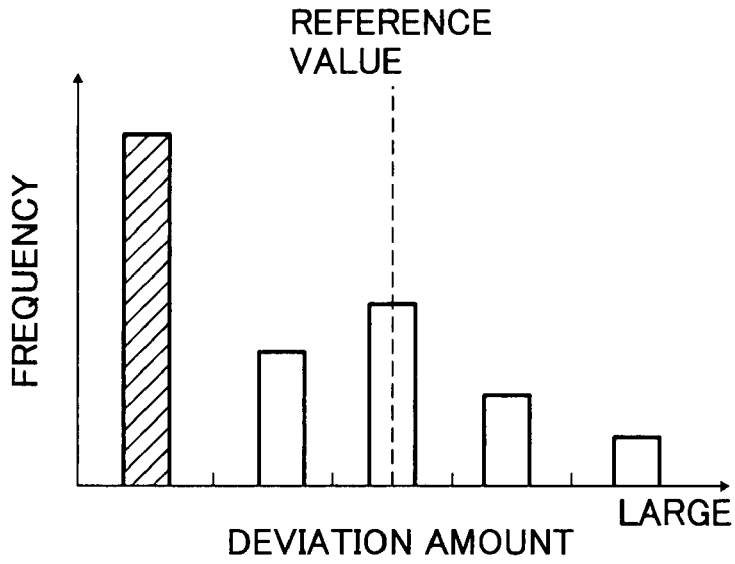
FIGS. 5A and 5B collectively illustrates an exemplary graph showing an exemplary relation between a deviation amount and a frequency.
Figure 5B:
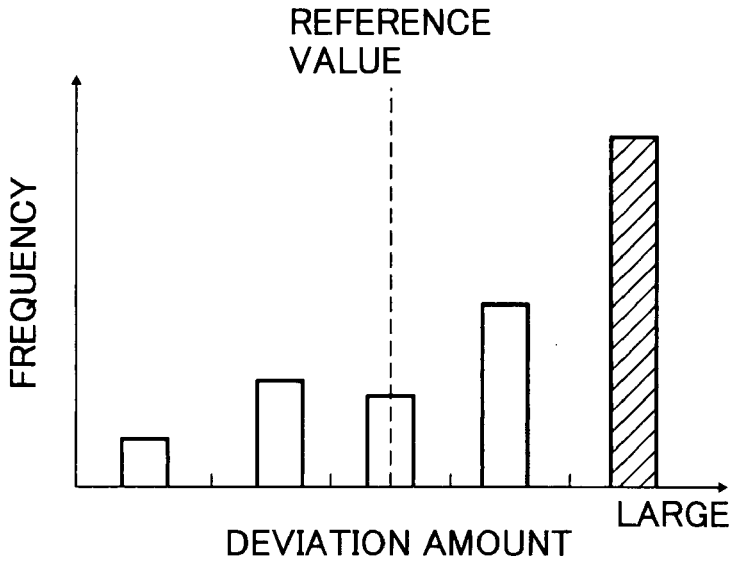

As shown in FIG. 5A, when the sum of the frequency is more than 10 and a peak of the distribution as shown by a slant line in the drawing lowers a prescribed reference value, it is determined that a service person call is not needed. Whereas as shown in FIG. 5B, when the peak of distribution as shown by the slant line in the drawing exceeds the prescribed reference value, it is determined that a service person call is necessary, and a instruction for issuing a service person call is provided to the service person call output device 22. Otherwise, as shown in FIGS. 6A and 6B, a number of output sheets calculated by subtracting a total number of output sheets at the time of the previous calibration from that at the present calibration can be segmentized into groups with a prescribed width in accordance with the number of output sheets, and a frequency can be measured per group.

Figure 6A:
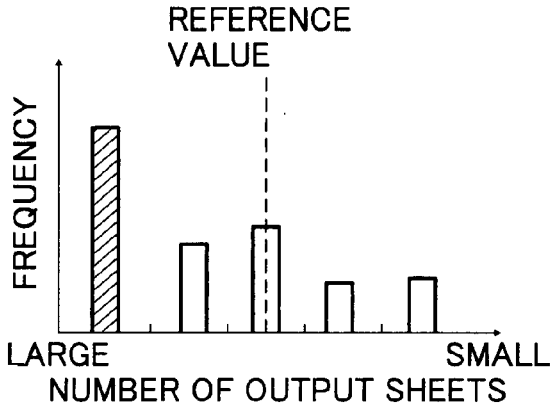
FIGS. 6A and 6B collectively illustrates an exemplary graph showing an exemplary relation between a number of output sheets and a frequency.
Figure 6B:
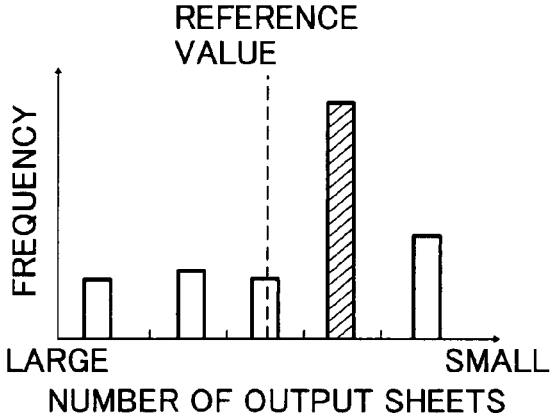

As shown in FIG. 6A, when the sum of the frequency exceeds 10 and a peak of distribution shown by a slant line in the drawing exceeds a prescribed reference value, it is determined that a service person call is not needed. While, as shown in FIG. 6B, when the peak of distribution as shown by the slant line in the drawing lowers the prescribed reference value, it is determined that a service person call is necessary, and a instruction for issuing a service person call is provided to the service person call output device 22.

Figure 7A:
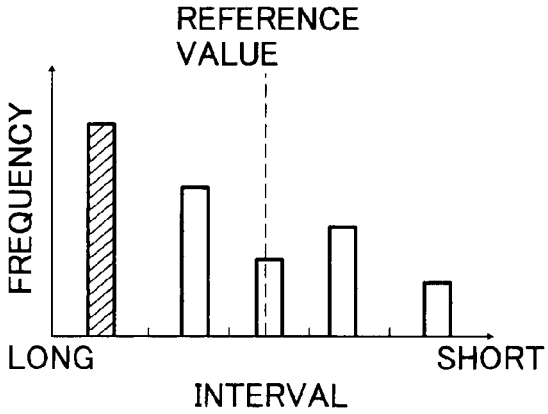
FIGS. 7A and 7B collectively illustrates an exemplary graph showing an exemplary relation between an interval and a frequency.
Figure 7B:
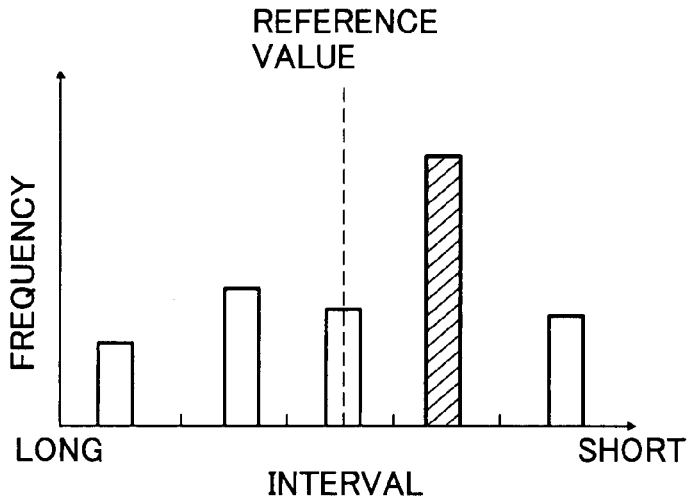

Still otherwise, as shown in FIGS. 7A and 7B, a time interval calculated by subtracting a date when the previous calibration is executed from a date when calibration is presently executed can be segmentized into groups with a prescribed width in accordance with the length of the interval. Then, a frequency can be measured per group. For example, the time interval can be a prescribed unit time, such as zero to one hour, more than one hour less then 24 hour, more than 24 hour less then one-week, etc. Then, as shown in FIG. 7A, when the sun of the frequency exceeds more than 10, and the peak of distribution as shown by the slant line in the drawing exceeds the prescribed reference value, it is determined that a service person call is not needed.

While as shown in FIG. 7B, when the peak of distribution as shown by the slant line in the drawing lowers the prescribed reference value, it is determined that a service person call is necessary, and a instruction for issuing a service person call is provided to the service person call output device 22.

In this way, the image forming apparatus of the first embodiment executes an ordinary calibration, in one hand, and on the other hand uses such calibration processing career information.

Further, either when a frequency of calibration increases or a number of corrections with a relatively large deviation amount is accumulated to a prescribed level, a service person call is issued.

Thus, an erroneous notification not in need of maintenance by a service person is decreased, while maintenance can be timely executed before a serious abnormality occurs in quality of an image.

Now, the second embodiment is described.

A difference from the first embodiment is that it is assumed that the deviation amount does not fall within the normal adjustable range when an image quality calculation device 152 executes determination if a deviation amount from a normal condition of an apparatus falls within a prescribed ordinal adjustable range in step S14. Specifically, when a solid image density decreases on an output material is step S11, a user uses the diagnosis execution instructing device 10 and instructs execution of calibration in step S12.

When diagnosis execution is instructed, the test pattern image creating device 11 transmits a signal indicative of a test pattern image including test patches with different output density step by step (per mono color when a color output apparatus is used) to an exposure device 12. Then, the exposure device 12 forms latent images of test patches on the image career member 13, and the developing device 14 then develops a toner image.

The density distribution measuring device 151 measures a physical characteristic amount such as density, a granularity level, etc., of the toner image of each of the test patches on the image bearing member 13.

Figure 8:
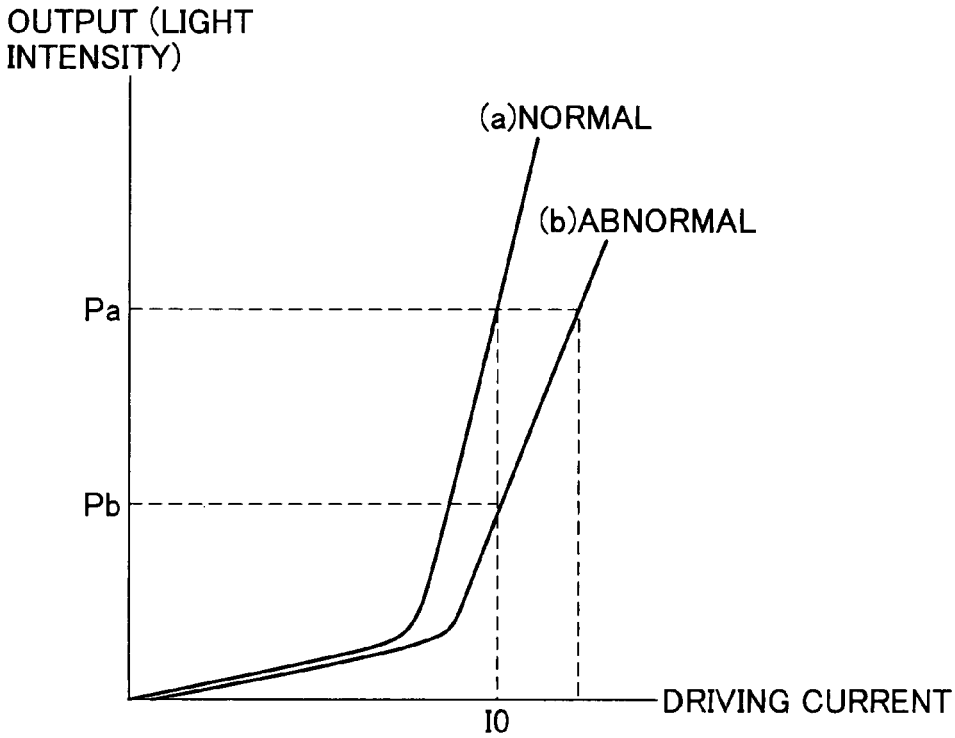
FIG. 8 illustrates an exemplary graph showing an exemplary relation between a driving current and light intensity of an element of a semiconductor laser.

The image quality calculation device 152 calculates a deviation amount from a normal condition by comparing a density of a normal condition stored in internal RAM with the physical characteristic amount measured by the density distribution measuring device 151. Then, the image quality calculation device 152 determines as being out of the normal adjustable range in step S114 when the physical characteristic amount deteriorates by 30% than the normal amount stored in the RAM. In such a situation, it is initially determined if there exists abnormality in the exposure system in step S30. FIG. 8 illustrates a relation between a light intensity and a driving current of one element of the semiconductor laser. It is understood in the case of a constant current driving that a light intensity is a level of Pa in relation to an input 10 in a normal condition, but decreases at a time of malfunction. Otherwise, an abnormality in the exposure system can be recognized when the light intensity is controlled to be constant and a current IO needed to obtain the amount of Pa is exceeded.

As another determining method of recognizing the abnormality of the exposure system, it is exemplified that no successful result is obtained even after the below described calibration executed in step S21 for abnormal use is executed for a time or when abnormal use image processing executed in step S23 is executed. Since various conditions arise when an electro-photographic engine is practically used, and it is difficult to determine every abnormality occurred in an exposure system, leakage of the determination of the abnormality can be reduced if a recovery countermeasure is taken.

Figure 4A:
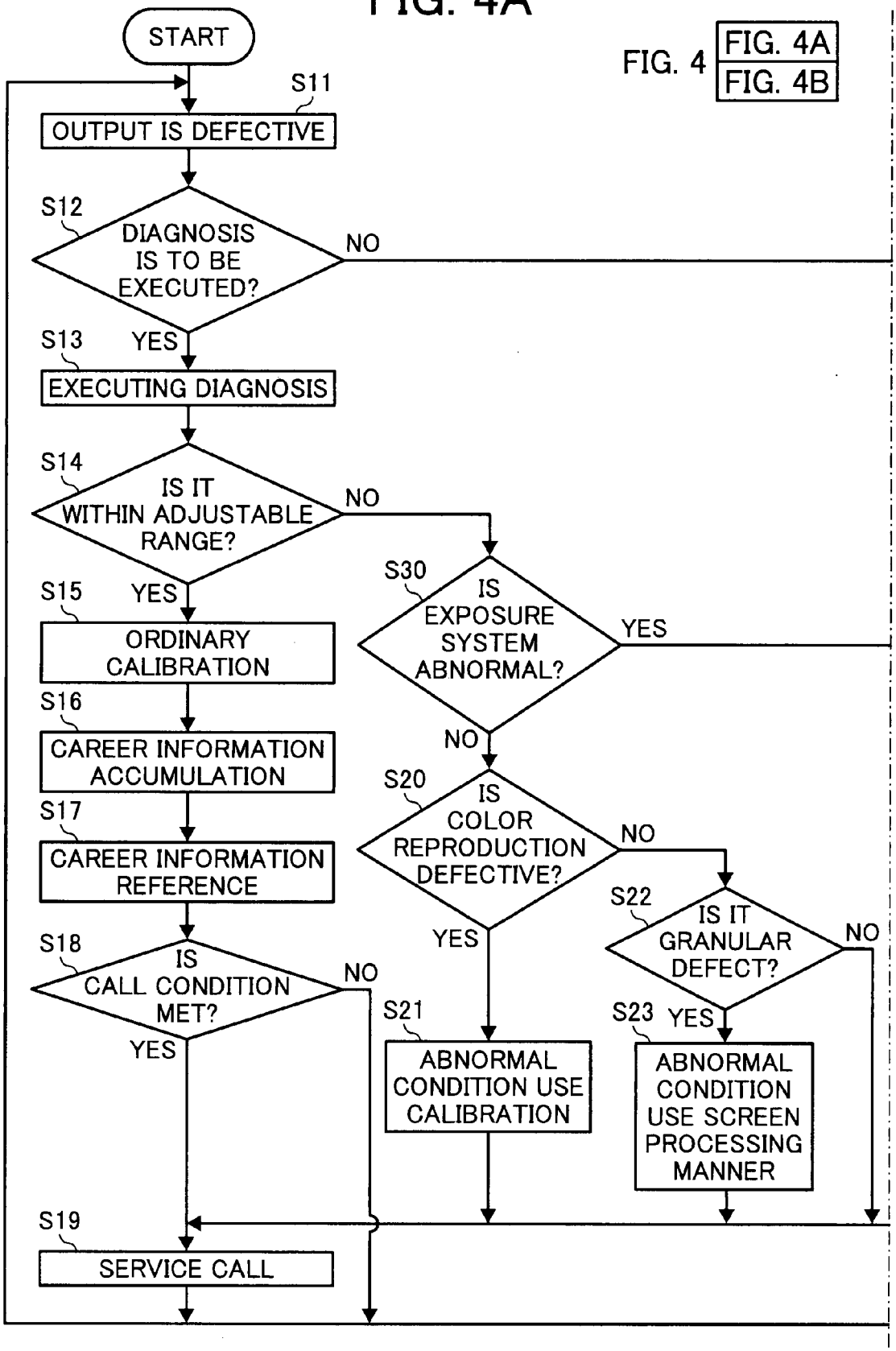
FIGS. 4A and 4B collectively illustrates an exemplary sequence of a control operation of the image forming apparatus of FIG. 1.
Figure 4B:
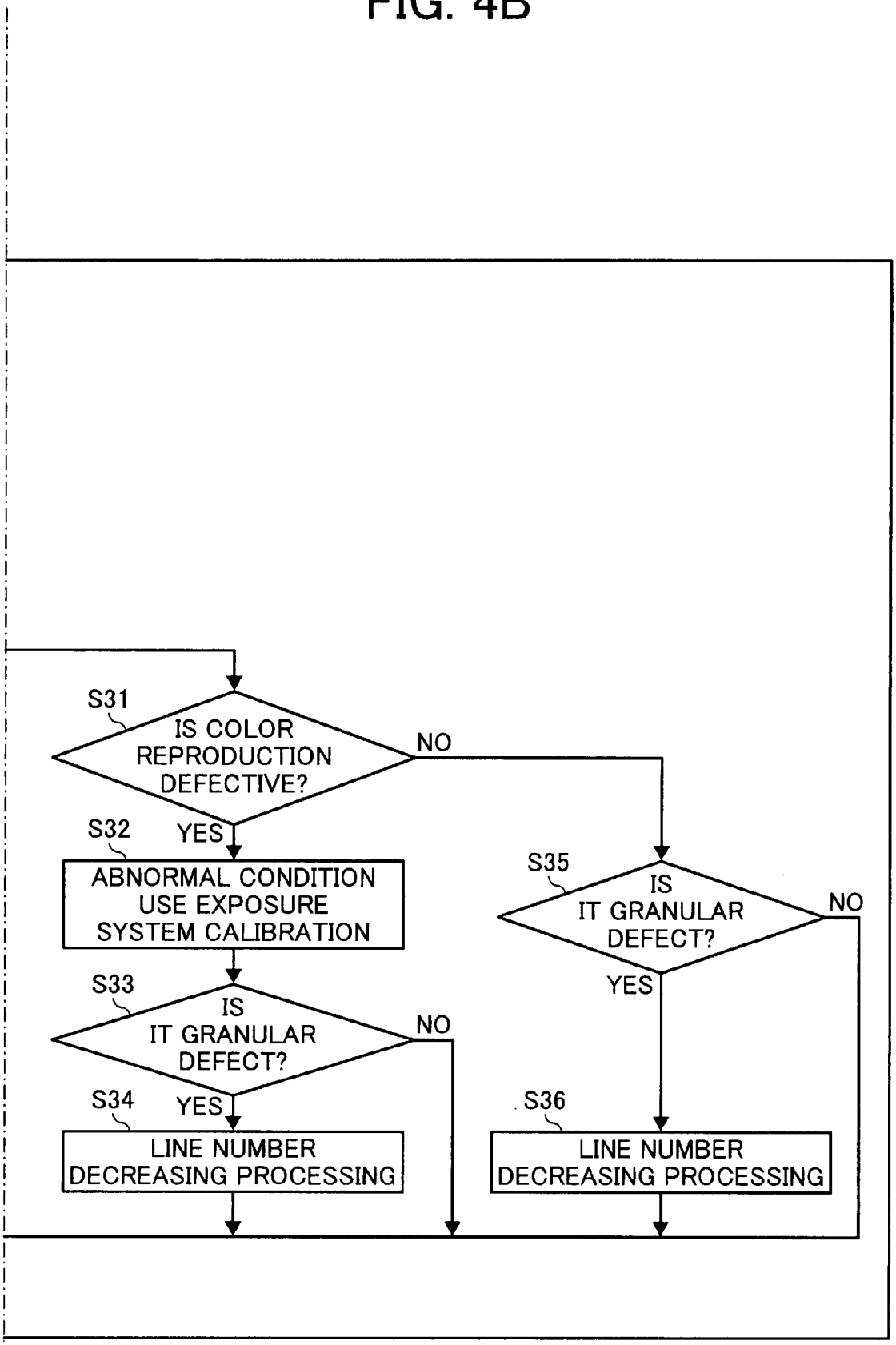
Figure 9:
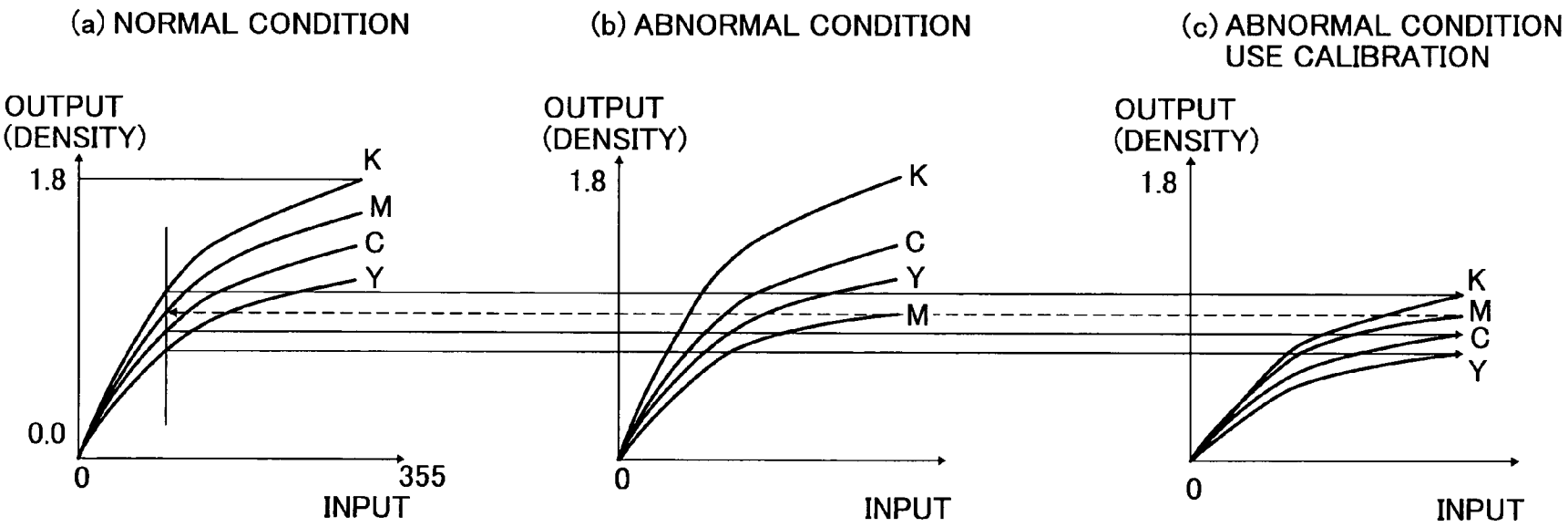
FIG. 9 illustrates an exemplary relation between an input and an output of an image.

Now, back to FIG. 4, an exemplary sequence after when the abnormality does not exist in the exposure system in step S30 is described. In such a situation, when a density of a toner image deviates from a normal value by a prescribed amount, it is determined that color reproduction causes a problem in step S20. Then, the image processing manner determining device 16 instructs the image processing device 17 in step S21 to execute an abnormal use calibration in accordance with a result of calculation executed by the image quality calculation device 152. Simultaneously, the image quality calculation device 152 transmits to the image processing manner determining device 16 a value of the maximum density per mono color (e.g. C, M, C, K) to the image processing manner determining device 16 when a color image forming apparatus is used. As an abnormal use calibration that the image processing device 17 executes, a calibration for maintaining a gray balance as far as possible may be employed as mentioned below. With reference to FIG. 9B, an exemplary situation when a density of Magenta widely decreases is now described. In such a situation, although it is attempted to create a gray with the same amount of respective toners of C, M, and Y, as usual, an unbalanced gray is obtained with slight green because of decreasing in a density of mono color M.

Then, the same density to the maximum density of the mono-color M at the abnormal time as shown in FIG. 9B are extracted based on a relation at a normal time between an input density and an output density stored in the RAM of the image quality calculation device 152. Then, as shown in FIG. 9C, densities of C, Y, and K in relation to the input at the time are adopted as the maximum densities for the respective mono colors. Thus, a calibration can be achieved even at the abnormal time while keeping the gray balance. In addition, an amount of the calibration is stored in a RAM of the image processing manner determining device 16.

The image processing device 17 refers to the RAM of the image processing manner determining device 16 and executes the abnormal use calibration. As a result, an appropriate density correction and halftone processing can be applied to image date inputted from the image inputting device 18. Then, an image is outputted when the image outputting device 19 executes transferring and fixing processes after respective operations of the exposure device 12, the image bearing member 13, and the developing device 14.

Further, the career information holding device 20 does not store a deviation amount from a normal condition as career information when the deviation amount exceeds a prescribed reference level.

The image processing manner determining device 16 directly outputs the deviation amount from the normal condition calculated by the image quality calculation device 152 to the service person call output determination device 21.

The service person call output determination device 21 instructs the service person call output device 22 to issue a service person call because thus received deviation amount from the normal condition exceeds the reference.

Thus, the image forming apparatus of the second embodiment executes an abnormal use calibration and outputs a service person call so as to maintain a gray balance when a problem related to image color reproduction arises.

Thus, outputs can be continuously obtained before maintenance is executed by a service person.

Accordingly, a completely unavailable time impossible for a user to use an image forming apparatus can be reduced.

Now, the third embodiment is described.

A difference from the second embodiment is that it is assumed that a determination result does not relate to the color production when an image quality calculation device 152 executes determination if a problem relates to color production in step S20.

Hereinbelow, only sequences after a step S22 are described, since operational sequences up to a step S20 are the same as in the second embodiment. The image quality calculation device 152 calculates a deviation amount by comparing a granularity level transmitted from the density distribution measuring device 151 with a normal value stored in the RAM, and then transfer the deviation amount to the image processing manner determining device 16. The image processing manner determination device 16 determines that a problem relates to granularity in step S22 when the deviation amount from the normal granularity exceeds the prescribed reference value, and forcibly switches to an abnormal use image processing manner in step S23.

For example, processing with a dither method is switched to a low line number dither processing method. Then, the image quality calculation device 152 transfers a deviation amount from a normal granularity to the service person call output determination device 21. The service person call output determination device 21 transmits an instruction to create a service person call to the service person call output device 22.

The above-mentioned deviation amount calculated by the image quality calculation device 152 can employ a Mahalanobis' generalized distance in relation to a reference space constructed by using a MTS manner.

Now, the MTS method is described in detail.

According to the method, a distance from a homogenous data group as a reference is calculated. An average of the Mahalanobis' generalized distance of data belonging to a reference space is one, and the distance becomes longer as a difference from reference data increases. Thus, when it is supposed that a data group outputted when an image forming apparatus normally operates is supposed to be a reference space and the Mahalanobis' generalized distance is around one, the image forming apparatus represents a performance almost as same as a normal condition. Specifically, the larger the Mahalanobis' generalized distance, the more serious abnormal level.

Figure 10:
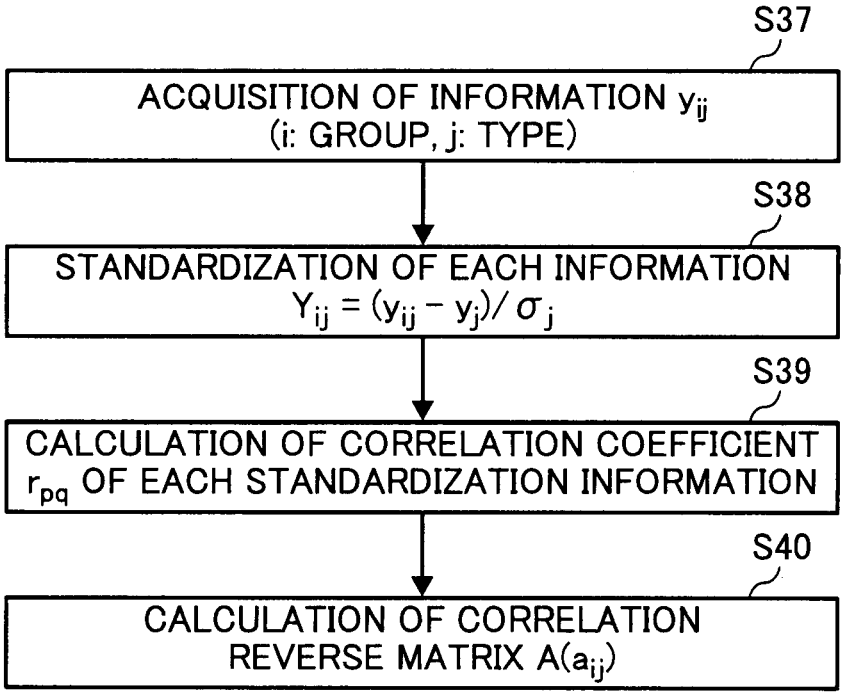
FIG. 10 illustrates an exemplary sequence for determining a manner and a formula of calculating a calculation value (e.g. a Mahalabinos' generalized distance) using a Mahalanobis-Taguchi System (hereinafter "MTS") method.

A sequence of determining a manner of calculating a calculation value (i.e., a distance of Maharanobis) and a calculation formula in accordance with a MTS manner is described with reference to a flowchart of FIG. 10.

Initially, n-group of k-number of information considered to be related to a condition of the image forming apparatus are obtained during an operation of the image forming apparatus in step S37. Herein, the table 1 illustrated in FIG. 16 represents a configuration of data thus obtained.

A shown, K-number of data are obtained in the first condition (e.g. a first day, a first unit or the like), and y11 to y1k are assigned thereto, respectively.

Similarly, data are obtained in the next condition (e.g. a second day, a second unit or the like) and are assigned with y2l to y2k, respectively. Thus, n-group of data can be obtained.

Then, raw (fresh) data (e.g. yij) are standardized using an average value (yj) and a standard deviation (σj) in step S38 using the first formula as shown in FIG. 18 per type (j) of information.

The table 2 illustrated in FIG. 19 represents a result of the standardization using the data shown in the table 1.

Then, all of correlation efficient rpq (=rqp) between data of the two groups among the k types are calculated using the second formula, and thereby a matrix R is obtained as the third formula as shown in FIG. 20 in step S39.

A reverse matrix of a correlation coefficient to the matrix R is then obtained as a matrix A as shown in the fourth formula in step S40.

As shown in the second formula, symbol Σ represents the total of suffix i.

Thus, a value of a calculation parameter used when a single calculation value is calculated can be determined.

Since the data group handled here represents those in a normal condition, the correlation is interrupted and the distance becomes larger when an abnormality such as a malfunction almost arises separated from the normal condition.

Figure 11:
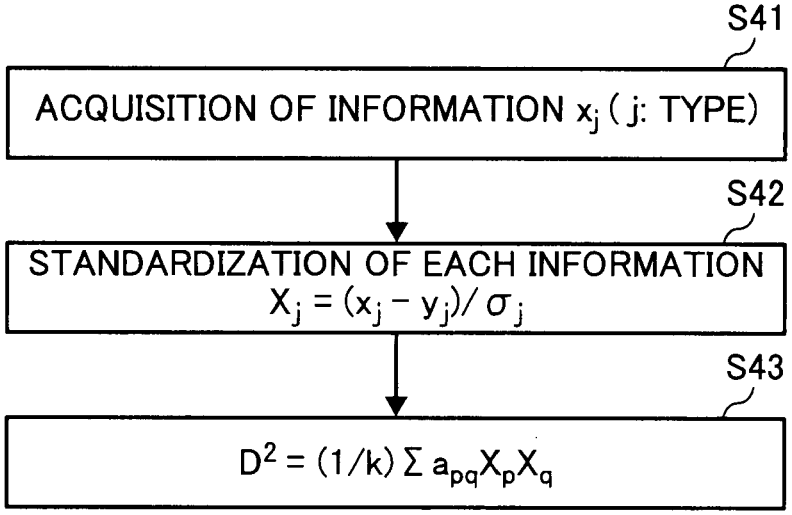
FIG. 11 illustrates an exemplary sequence for calculating a calculation value at an optional time.

Now, an exemplary sequence for calculating a calculation value at an optional time is described with reference to FIG. 11.

A calculation value can be obtained at the optional time as follows:

Initially, k-types of data xl to xk are obtained at an optional condition in step S41. The data type corresponds to y11 to y1k or the like. Then, the data thus obtained are standardized in step S42 using the represented by the number 5. The standardized data are assigned xl to xk. Then, a calculation value $D^2$ is calculated in step S43 using the sixth calculation formula shown in FIG. 23 as determined using elements akk of the reverse matrix A already sought. "D" as a square root of this value is called the Mahalanobis' generalized distance, and is regarded as a calculation value. Further, Σ in the sixth formula represents the total related to suffixes p and q.

In this embodiment, as shown in the table 1, a plurality of output values outputted from various sensors employed in the image forming apparatus are obtained during a normal operation, and a reference space is constructed based on the output values.

Objective to establish a system using the MTS method is not limited to the input information of the table 3, and includes a combination of the other information.

However, it is limited to a few types of input information.

In this way, according to the image forming apparatus of the third embodiment, when a problem related to granularity occurs, an operation is switched to an abnormal use halftone processing manner, and a service person call is outputted.

Thus, the output can be continued until the service person arrives, and thus, a completely unavailable time for the image forming apparatus can be reduced.

Now, the fourth embodiment is described with reference to FIG. 4, wherein it is supposed that a problem neither relates to image color reproduction nor granularity occurs in step S22 in FIG. 4. In such a situation, a user is highly probably dissatisfied with a problem impossible for a sensor or the like included in the image forming apparatus to detect. Thus, the image processing manner determining device 16 directly transmits information of both of deviation of density less than a reference value and granularity to the service person call output determination device 21. Upon receiving the information from the image processing manner determining device 16, the service person call output determination device 21 instructs the service person call output device 22 to output a service person call without any condition. Upon receiving the instruction, the service person call output device 22 issues a service person call in step S19. Thus, even when a problem other than the image color reproduction and the image granularity occurs, the image forming apparatus of FIG. 4 can allow a service person to execute maintenance at an early stage.

Now, the fifth embodiment is described wherein it is supposed that a problem related an exposure system occurs during processing in step S30 in FIG. 4. When the exposure system causes a problem (i.e., Yes, in step S30), it is determined in step S31 if color reproduction causes a problem in step S31. Specifically, a density distribution measuring device 151 measures a physical performance of a toner image of respective test patches, such as density, granularity, etc. When the density of the toner image deviates from the normal value by more than a prescribed value, it is determined that the color reproduction causes a problem in step S31. In such a situation, the exposure device 12 is instructed to execute calibration for abnormal use in step S32. A calibration for the abnormal use, calibration for a light intensity in a multiple beam system is exemplified. Specifically, as shown in FIG. 8, each of driving currents supplied to each of laser elements to execute constant current driving is separately calibrated again, and a light intensity of a target is lowered down to Pb, for example, so that light intensity of the respective elements can become substantially the same, even decreased.

As a result, a problem related to color reproduction can be suppressed. Since the maximum density decreases when the light intensity decreases, it is more preferable if the same calibration as the abnormal use calibration executed in step S21 of the second embodiment is executed, simultaneously.

Now, an exposure device is described with reference to FIG. 12 before the other abnormal use calibration in the exposure device 12 is explained. As shown, an exposure device and surroundings operating with dual beams are illustrated in FIG. 12.

The reference number 61 denotes a collimator unit as a light source section. The collimator unit 61 includes a plurality of collimator lenses 613 and 614, a plurality of semiconductor lasers 615 and 616, and a prism 617 for almost approximating light paths of the laser beams. The laser beams emitted from the collimator unit 61 become almost parallel to each other after passing through a cylindrical lens 62. The light is then scanned in a horizontal direction by a polygon 63. The light thus scanned is concentrated on the image bearing member 13 and scanned in a main scanning direction through a f-theta lens 64 and a Troidal lens 65. A horizontal synchronization sensor 69 is arranged on the scan starting side and outputs a trigger signal. Based on the trigger signal, a phase synchronization signal generation circuit 70 outputs a synchronization signal representing scanning start. The synchronization signal is transmitted to a video control section 71.

The video control section 71 includes a ROM 72 for creating a test pattern, and is connected to an operation panel 73, and an interface circuit 74 for image data. An image signal from the video control section 71 is transmitted to a LD driving circuit 75 so as to drive the semiconductor lasers 615 and 616.

Figure 12:
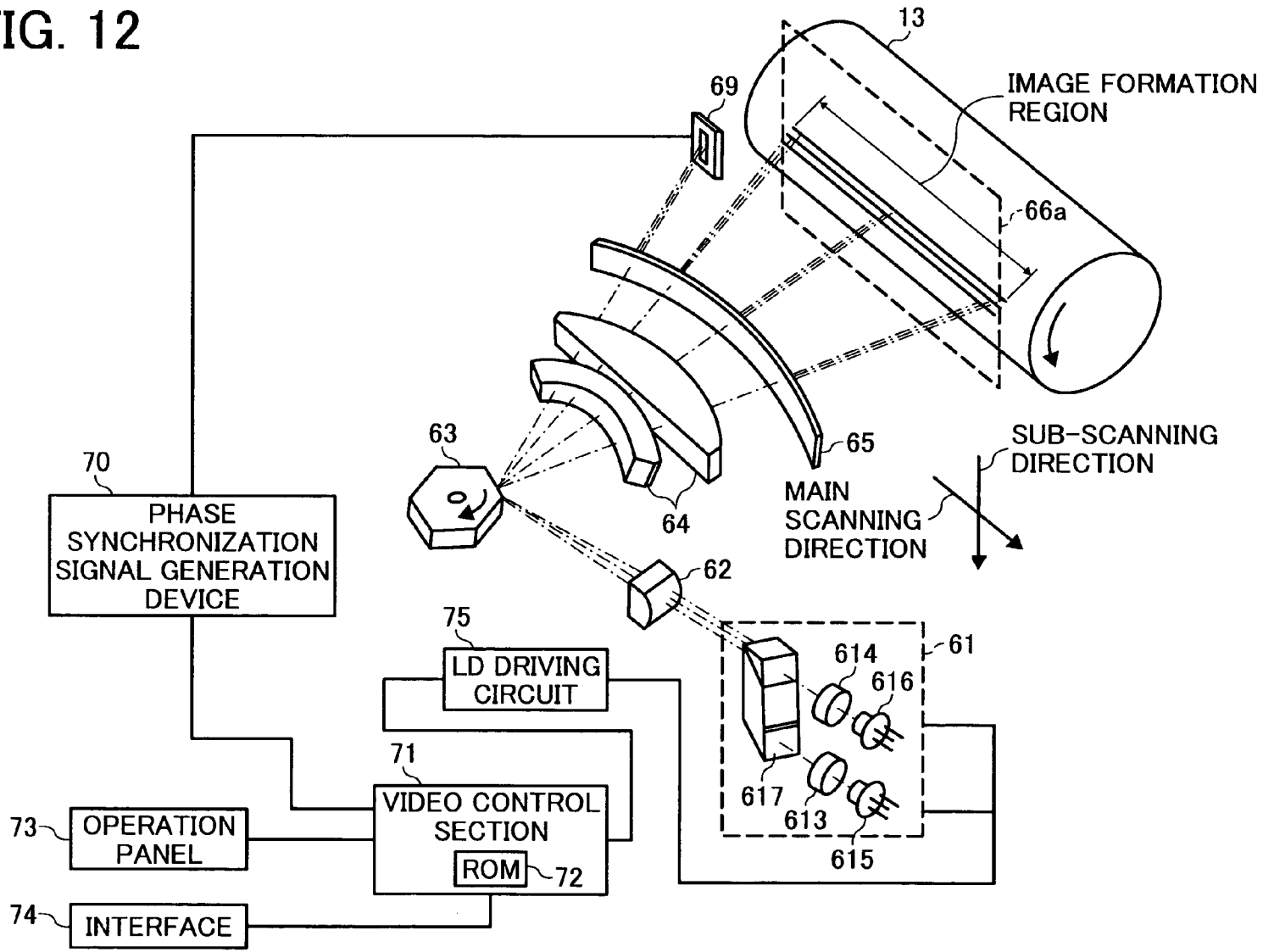
FIG. 12 illustrates an exemplary exposure device and its surroundings using dual beams.
Figure 13:
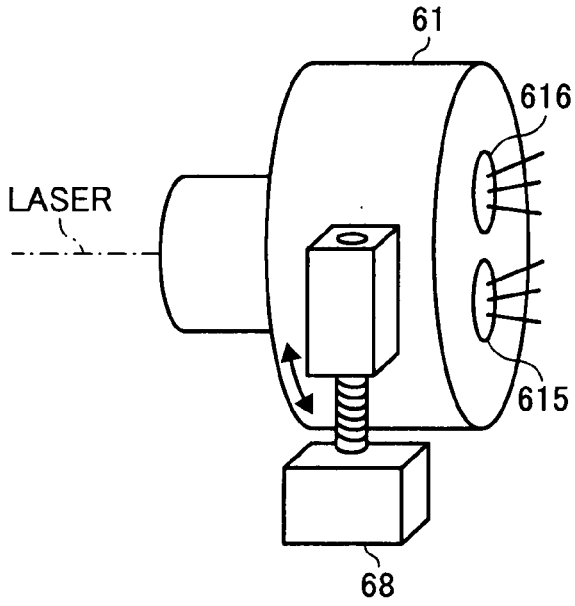
FIG. 13 illustrates an exemplary adjusting mechanism for a collimator unit shown in FIG. 12.

An exemplary adjustment mechanism for the collimator unit shown in FIG. 12 is described with reference to FIG. 13.

A beam pitch is adjusted by moving the collimator unit 61 by means of an adjusting mechanism 68. Specifically, when a region impossible to execute scanning (i.e., exposure) is created due to a deviation of a scanning pitch, such scanning is recovered to be uniform by adjusting a pitch again. Such an adjustment of the exposure pitch can be executed using an evaluation chart as described in the Japanese Patent Registration No. 3254392 and the optical sensor 31 as described with reference to FIG. 3. When the abnormal use calibration step in step S32 is completed, a test pattern is created again after the calibration, and then it is determined as to a problem related to granularity is executed in step S33. The same manner to that used in step S22 can be used. When it is determined that there exists a problem related to granularity performance, an operation is switched to an abnormal use image processing in step S34. If it is not determined that there exists a problem related to granularity in step S33, the step S34 is not executed. Then, the image quality calculation device 152 transmits a deviation amount from a normal granularity to the service person call output determination device 21. The service person call output determination device 21 then transmits an instruction to the service person call output device 22 to issue a service person call.

Now an exemplary image processing for abnormal use performed in step S34 is described with reference to FIG. 14, wherein a number of processing lines in a dither method is decreased.

Figure 14A:
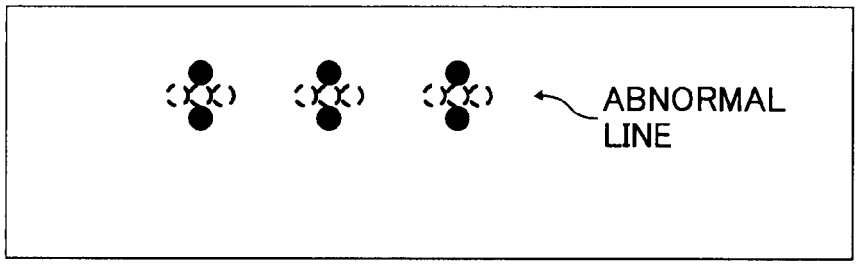
FIGS. 14A and 14B collectively illustrates an exemplary image processing for abnormal use.

Specifically, when a high line number dither is used and scanning is executed by a polygon while a laser includes a problem, a problem is caused as to a scanning line as shown in FIG. 14A.

Figure 14B:
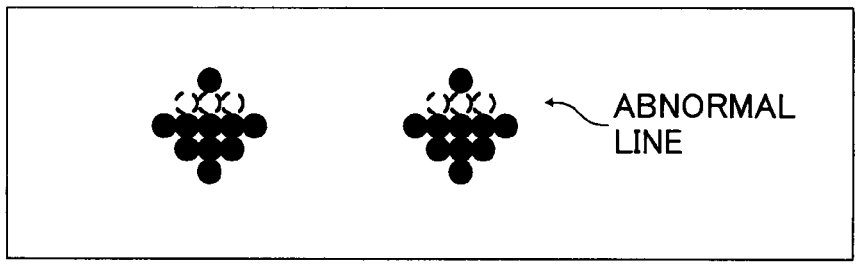

Such affection is serious in the high line number dither, because a small number of dots form a grid. However, since a number of dots forming a grid increases in case of using a low line number dither as shown in FIG. 14B, in proportion to a number of multiple beams, a level of a dot formation problem caused by a light emission error can be decreased.

Figure 15A:
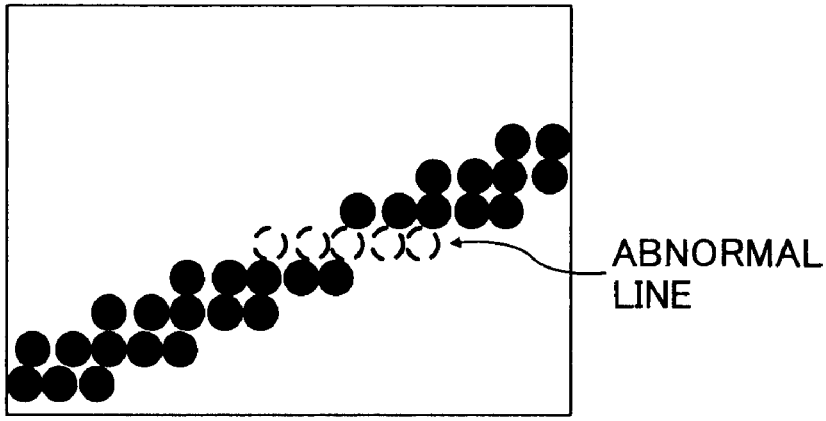
FIGS. 15A and 15B collectively illustrates another exemplary image processing for abnormal use.

Another exemplary image processing for abnormal use to be performed in step S34 is now described with reference to FIG. 15, wherein a screen angle of processing is changed in a dither method. In a color electro-photographic engine, a screen angle is added in a dither method. However, abnormality in an exposure device 12 readily causes affection when a difference between screen and scanning line angles is small as shown in FIG. 15A.

Figure 15B:
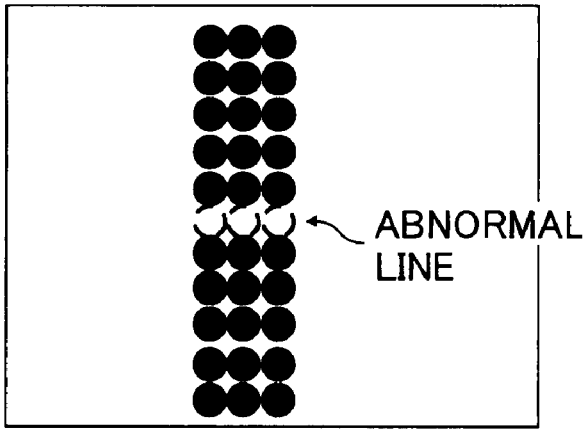

Thus, when the screen angle is changed as shown in FIG. 15B, such affection of the abnormality can be suppressed not to be prominent.

Now, the sixth embodiment is described, wherein an exemplary sequence is described when it is determined in step S31 that a problem relates to color reproduction different from the fifth embodiment. The image quality calculation device 152 calculates a deviation amount by comparing a normal value stored in a RAM with a granularity transmitted from the density distribution measuring device 151, and transmits the deviation amount to the image processing manner determining device 16.

The image processing manner determining device 16 determines that a problem relates to a granularity when the deviation amount from the normal one exceeds a prescribed reference value in step S35, and forcibly switches a manner to the abnormal use image processing manner in step S36. Such an abnormal use image processing manner can be the same to that executed in step S34.

The image quality calculation device 152 then transmits the deviation amount from the normal granularity to the service person call output determination device 21. The service person call output determination device 21 then transmits an instruction to the service person call output device 22 to issue a service person call.

Now, the seventh embodiment is described, wherein it is supposed in step S35 that a problem does not relate to image color reproduction and granularity. In such a situation, it is recognized that the exposure device 12 causes some problem.

Specifically, a problem impossible for a sensor included in the image forming apparatus to detect occur. Accordingly, a user highly probably feels complaint about it. Then, the image processing manner determining device 16 directly transmits information such as a density deviation amount less than a reference value, a granularity level, etc., to the service person call output determination device 21. The service person call output determination device 21 instructs the service person call output device 22 to issue a service person call without any condition upon receiving the information from the image processing manner determining device 16. The service person call output device 22 issues a service person call in accordance with the instruction.

In this way, the image forming apparatus according to the seventh embodiment, maintenance can be executed by a service person at an earlier stage even when a problem unrelated to image color reproduction and image granularity occurs.

Further, a downtime of the apparatus can be minimized.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

a condition determining device configured to calculate a deviation amount of image data from a normal condition and configured to determine if the image forming apparatus is in an abnormal condition;

an abnormal section specifying device configured to specify an abnormal section in the image forming apparatus based on a condition of the image forming apparatus;

an image processing device configured to execute image processing for abnormal use in accordance with an output of the abnormal section specifying device when the image data condition determining device determines that the image forming apparatus is in an abnormal condition; and a service person call output device configured to output a service person call signal indicative of calling a service person to a center when the image data condition determining device determines that the image forming apparatus is in an abnormal condition, wherein said condition determining device determines a deviation amount from the normal condition based on granularity of an image, wherein said image processing device determines if an abnormality is present in an exposure system when the condition determining device determines that the image forming apparatus is in the abnormal condition, and wherein said image processing device executes halftone processing for abnormal use based on the result of the abnormality presence determination, wherein said halftone processing for abnormal use at least includes one of switching processing for decreasing a frequency of an image to be formed and switching processing for changing a screen angle.

2. The image forming apparatus according to claim 1, further comprising a career holding device configured to hold a career of the deviation amount calculated by the condition determining device, wherein said service person call output device outputs service person call information in accordance with career information of the career holding device.

3. The image forming apparatus as claimed in claim 2, wherein said career information includes one of the deviation amount calculated by the condition determining device, a calibration interval calculated from a date when the image processing device executes previous calibration, and the total number of outputs of recording mediums when the calibration is executed, wherein one of said deviation amount, the calibration interval, and the total number of outputs is segmentized into a prescribed number of groups in an order of a volume of the information, and wherein said service person call is generated when a frequency of a prescribed group exceeds a prescribed reference.

4. An image forming apparatus, comprising:

a condition determining device configured to calculate a deviation amount of image data from a normal condition and configured to determine if the image forming apparatus is in an abnormal condition;

an abnormal section specifying device configured to specify an abnormal section in the image forming apparatus based on a condition of the image forming apparatus;

an image processing device configured to execute image processing for abnormal use in accordance with an output of the abnormal section specifying device when the image data condition determining device determines that the image forming apparatus is in an abnormal condition;

a service person call output device configured to output a service person call signal indicative of calling a service person to a center when the image data condition determining device determines that the image forming apparatus is in an abnormal condition; and a career holding device configured to hold a career of the deviation amount calculated by the condition determining device, wherein said service person call output device outputs service person call information in accordance with career information of the career holding device.

5. The image forming apparatus as claimed in claim 4, wherein said career information includes one of the deviation amount calculated by the condition determining device, a calibration interval calculated from a date when the image processing device executes previous calibration, and the total number of outputs of recording mediums when the calibration is executed.

6. The image forming apparatus as claimed in claim 5, wherein one of said deviation amount, the calibration interval, and the total number of outputs is segmentized into a prescribed number of groups in an order of a volume of the information.

7. The image forming apparatus as claimed in claim 6, wherein said service person call is generated when a frequency of a prescribed group exceeds a prescribed reference.

8. The image forming apparatus according to claim 4, wherein said deviation amount is obtained using a Mahalanobis-Taguchi System (hereinafter "MTS") method, and includes a Mahalanobis' generalized distance in relation to a reference space determined based on two or more information detected when the image forming apparatus is in the normal condition.

9. An image forming apparatus, comprising:

a condition determining device configured to calculate a deviation amount of image data from a normal condition and configured to determine if the image forming apparatus is in an abnormal condition;

an abnormal section specifying device configured to specify an abnormal section in the image forming apparatus based on a condition of the image forming apparatus;

an image processing device configured to execute image processing for abnormal use in accordance with an output of the abnormal section specifying device when the image data condition determining device determines that the image forming apparatus is in an abnormal condition; and a service person call output device configured to output a service person call signal indicative of calling a service person to a center when the image data condition determining device determines that the image forming apparatus is in an abnormal condition, wherein said deviation amount is obtained using a Mahalanobis-Taguchi System (hereinafter "MTS") method, and includes a Mahalanobis' generalized distance in relation to a reference space determined based on two or more information detected when the image forming apparatus is in the normal condition.

10. The image forming apparatus according to claim 9, wherein said condition determining device determines a deviation amount from the normal condition based on granularity of an image.

11. The image forming apparatus according to claim 10, wherein said image processing device determines if an abnormality is present in an exposure system when the condition determining device determines that the image forming apparatus is in the abnormal condition.

12. The image forming apparatus according to claim 11, wherein said image processing device executes halftone processing for abnormal use based on the result of the abnormality presence determination.

13. The image forming apparatus according to claim 12, wherein said halftone processing for abnormal use at least includes one of switching processing for decreasing a frequency of an image to be formed and switching processing for changing a screen angle.

14. The image forming apparatus according to claim 9, wherein said condition determining device determines a deviation amount from the normal condition based on a performance of image color reproduction.

15. The image forming apparatus according to claim 14, wherein said image processing device determines if an abnormality is present in an exposure system of the image forming apparatus when the condition determining device determines that the image forming apparatus is in the abnormal condition.

16. The image forming apparatus according to claim 15, wherein the image processing device executes calibration for abnormal use based on the result of the abnormality presence determination.

17. The image forming apparatus according to claim 16, wherein said calibration includes one of output density correction processing for maintaining a gray balance and correction processing for correcting an exposure position.

* * * * *